US006293344B1

(12) United States Patent
Nixon et al.

(10) Patent No.: US 6,293,344 B1
(45) Date of Patent: Sep. 25, 2001

(54) RETAINER VALVE

(75) Inventors: Vance E. Nixon, Rosharon; Gary L. Rytlewski, League City; Anthony P. Vovers, Houston, all of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/362,784

(22) Filed: Jul. 28, 1999

Related U.S. Application Data

(60) Provisional application No. 60/094,582, filed on Jul. 29, 1998.

(51) Int. Cl.[7] ..... E21B 34/02

(52) U.S. Cl. ..... 166/363; 166/365; 166/321

(58) Field of Search ..... 166/321, 322, 166/339, 363, 364, 365, 97.1

(56) References Cited

U.S. PATENT DOCUMENTS

| | | | | |
|---|---|---|---|---|
| 4,253,525 | | 3/1981 | Young . | |
| 4,325,409 | | 4/1982 | Roberts . | |
| 4,436,157 | * | 3/1984 | Brooks | 166/344 |
| 4,658,904 | * | 4/1987 | Doremus et al. | 166/336 |
| 4,880,060 | * | 11/1989 | Schwendemann et al. | 166/336 |
| 5,771,974 | * | 6/1998 | Stewart et al. | 166/336 |
| 5,782,304 | | 7/1998 | Garcia-Soule et al. . | |

FOREIGN PATENT DOCUMENTS

0844365A2 5/1998 (EP) .

OTHER PUBLICATIONS

British Patent Office Communication dated Sep. 3, 1999.

* cited by examiner

*Primary Examiner*—David Bagnell
*Assistant Examiner*—John Kreck
(74) *Attorney, Agent, or Firm*—Trop Pruner & Hu P.C.

(57) ABSTRACT

An apparatus for retaining fluid in a pipe includes an elongated body adapted to be positioned within a subsea wellhead assembly. The elongated body has an end adapted for connection to the pipe, a flow passage for fluid communication with the pipe, and an outer surface for engagement with a sealing member in the subsea wellhead assembly. A first chamber is defined within the elongated body and connected to receive pressure from above the subsea wellhead assembly. A second chamber is defined within the elongated body and connected to receive pressure from below the subsea wellhead assembly. A valve is supported in the elongated body for movement in response to pressure differential between the first and the second chambers. The valve is movable between an open position to permit fluid flow through the flow passage and a closed position to prevent fluid flow through the flow passage.

29 Claims, 5 Drawing Sheets

RETAINER VALVE

This application claims benefit of Provisional No. 60/094,582 filed Jul. 29, 1998.

BACKGROUND OF THE INVENTION

1. Technical Field

The invention relates generally to safety shut-in systems employed during testing or other operations in subsea wells. More particularly, the invention relates to a safety shut-in system having a valve for trapping fluid under pressure in a pipe string.

2. Background Art

Offshore systems which are employed in relatively deep water for well operations generally include a riser which connects a surface vessel's equipment to a blowout preventer stack on a subsea wellhead. Offshore systems which are employed for well testing operations also typically include a safety shut-in system which automatically prevents fluid communication between the well and the surface vessel in the event of an emergency, such as when conditions in the well deviate from preset limits. Typically, the safety shut-in system includes a subsea test tree which is landed inside the blowout preventer stack on a pipe string. The subsea test tree generally includes a valve portion which has one or more normally closed valves that can automatically shut-in the well. The subsea test tree also includes a latch portion which enables the portion of the pipe string above the subsea test tree to be disconnected from the subsea test tree.

The subsea test tree may be used in conjunction with a retainer valve and a bleed-off valve. The retainer valve is commonly arranged in the pipe string to prevent fluid from being dumped from the pipe string into the riser when the pipe string is disconnected from the valve portion. The bleed-off valve allows controlled venting of pressure that may be trapped between the closed retainer valve and the closed valve portion of the subsea test tree. Generally, the subsea test tree, the retainer valve, and the bleed-off valve are controlled by fluid pressure in control lines which extend from a pressure source on the vessel to the subsea test tree, the retainer valve, and the bleed-off valve.

The retainer valve may be a normally-open or fail-safe-open retainer valve or may be a normally-closed or fail-safe-close retainer valve. When pressure is lost in the control line connected to the retainer valve, a fail-safe-open retainer valve defaults to the open position while a fail-safe-close retainer valve defaults to the closed position. For a fail-safe-close retainer, if the retainer-valve control line is inoperable, e.g., if the retainer-valve control line is inadvertently severed, the fail-safe-close retainer valve remains closed. However, it may be necessary to re-open the retainer valve to permit other operations to be carried out on the well, e.g., kill the well or retrieve a portion of a tubing or wireline which was severed when the retainer valve was closed. Thus, it would be desirable to provide a secondary means through which the retainer valve can be opened if the retainer-valve control line is inoperable.

Conventionally, three control lines are provided to operate the valve portion of the subsea test tree, the latch portion of the subsea test tree, the retainer valve, and the bleed-off valve. However, conventional systems do not allow for independent control of the valve portion of the subsea test tree, the latch portion of the subsea test tree, the retainer valve, and the bleed-off valve. Typically, the valve portion, the latch portion, and the retainer valve have their own dedicated control lines, and fluid pressure in one of the three control lines operate the bleed-off valve. For example, it is common to connect the control line that operates the latch portion to the bleed-off valve such that fluid pressure in the latch control line opens the bleed-off valve to vent pressure trapped between the retainer valve and the valve portion before the latch portion is disconnected from the valve portion. To allow independent control of the retainer valve, the valve portion of the subsea test tree, the latch portion of the subsea test tree, and the bleed-off valve, an additional control line may be provided to operate the bleed-off valve, but this would generally result in incompatibility with existing equipment. Therefore, it is desirable to provide a method for independently controlling the operation of the valve portion of the subsea test tree, the latch portion of the subsea test tree, the retainer valve, and the bleed-off valve using three control lines.

SUMMARY OF THE INVENTION

One aspect of the invention is an apparatus for retaining fluid in a pipe which comprises an elongated body adapted to be positioned within a subsea wellhead assembly. The elongated body has an end adapted for connection to the pipe, a flow passage for fluid communication with the pipe, and an outer surface for engagement with a sealing member in the subsea wellhead assembly. A first chamber is defined within the elongated body and connected to receive pressure from above the subsea wellhead assembly. A second chamber is defined within the elongated body and connected to receive pressure from below the subsea wellhead assembly. A valve is supported in the elongated body for movement in response to pressure differential between the first and second chambers. The valve is movable between an open position to permit fluid through the flow passage and a closed position to prevent fluid flow through the flow passage.

Other aspects and advantages of the invention will become apparent from the following description and from the appended claims.

DESCRIPTION OF THE PREFERRED EMBODIMENTS

Figure 1:
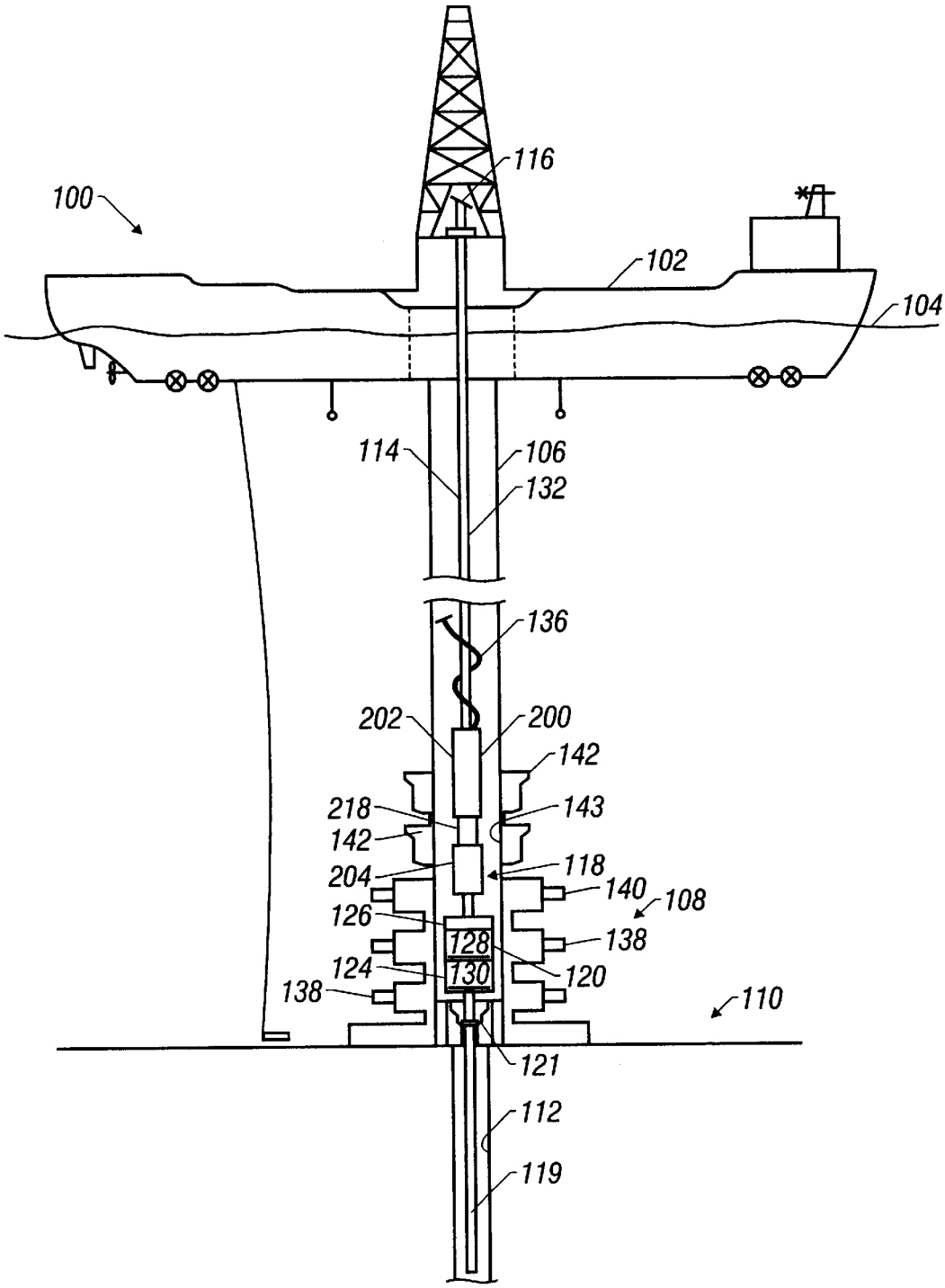
FIG. 1 shows a schematic view of a subsea production well testing system.

FIG. 1 illustrates a subsea production well testing system 100 which may be employed to test production characteristics of a well. The subsea production well testing system 100 comprises a vessel 102 which is positioned on a water surface 104 and a riser 106 which connects the vessel 102 to a blowout preventer stack 108 on the seafloor 110. A well 112 has been drilled into the seafloor 110, and a tubing string 114 extends from the vessel 102 through the blowout preventer stack 108 into the well 112. The tubing string 114 is provided with a bore 116 through which hydrocarbons or other formation fluids can be conducted from the well 112 to the surface during production testing of the well. A test device, such as a pressure/temperature sub, may be provided in the tubing string 114 to monitor the flow of formation fluids into the tubing string 114.

The well testing system 100 includes a safety shut-in system 118 which provides automatic shut-in of the well 112 when conditions on the vessel 102 or in the well 112 deviate from preset limits. The safety shut-in system 118 includes a subsea tree 120 and a retainer valve 200. The subsea tree 120 is landed in the blowout preventer stack 108 on the tubing string 114. A lower portion 119 of the tubing string 114 is supported by a fluted hanger 121. The subsea tree 120 has a valve assembly 124 and a latch 126. The valve assembly 124 acts as a master control valve during testing of the well 112. The valve assembly 124 includes a normally-closed flapper valve 128 and a normally-closed ball valve 130. The flapper valve 128 and the ball valve 130 may be operated in series. The latch 126 allows an upper portion 132 of the tubing string 114 to be disconnected from the subsea tree 120 if desired. It should be clear that the invention is not limited to the particular embodiment of the subsea tree 120 shown, but any other valve system that controls flow of formation fluids through the tubing string 114 may also be used.

The retainer valve 200 is arranged at the lower end of the upper portion 132 of the tubing string 114 to prevent fluid in the upper portion 132 of the tubing string from draining into the riser 106 when disconnected from the subsea tree 120. The retainer valve 200 also allows fluid from the riser 106 to flow into the upper portion 132 of the tubing string 114 so that hydrostatic pressure in the upper portion 132 of the tubing string 114 is balanced with the hydrostatic pressure in the riser 106. An umbilical 136 provides the fluid pressure necessary to operate the valve portion 124, the latch 126, and the retainer valve 200. The umbilical 136 has three control lines which are connected to a pressure source on the vessel 102.

Figure 2A:
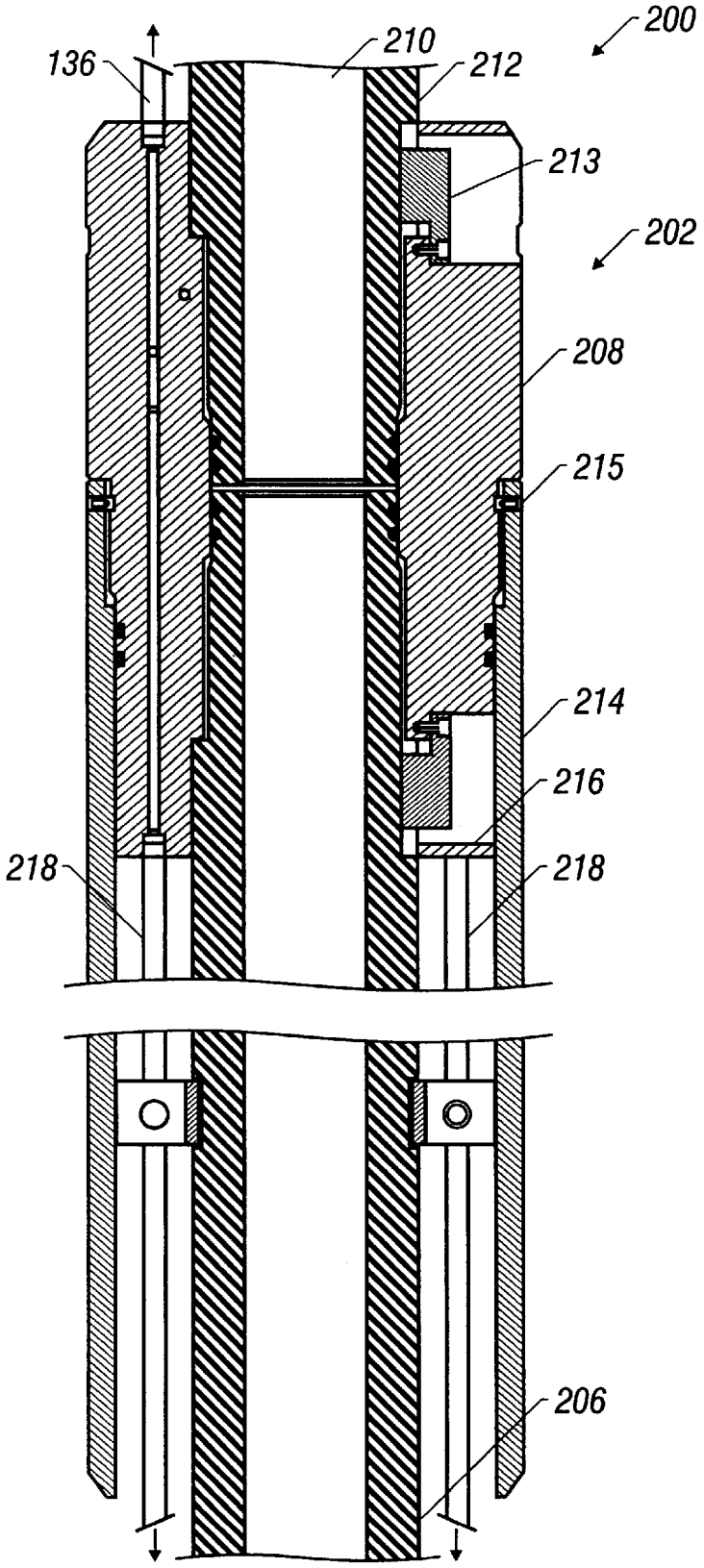
FIGS. 2A and 2B are cross-sectional views of the retainer valve shown in FIG. 1.
Figure 2B:
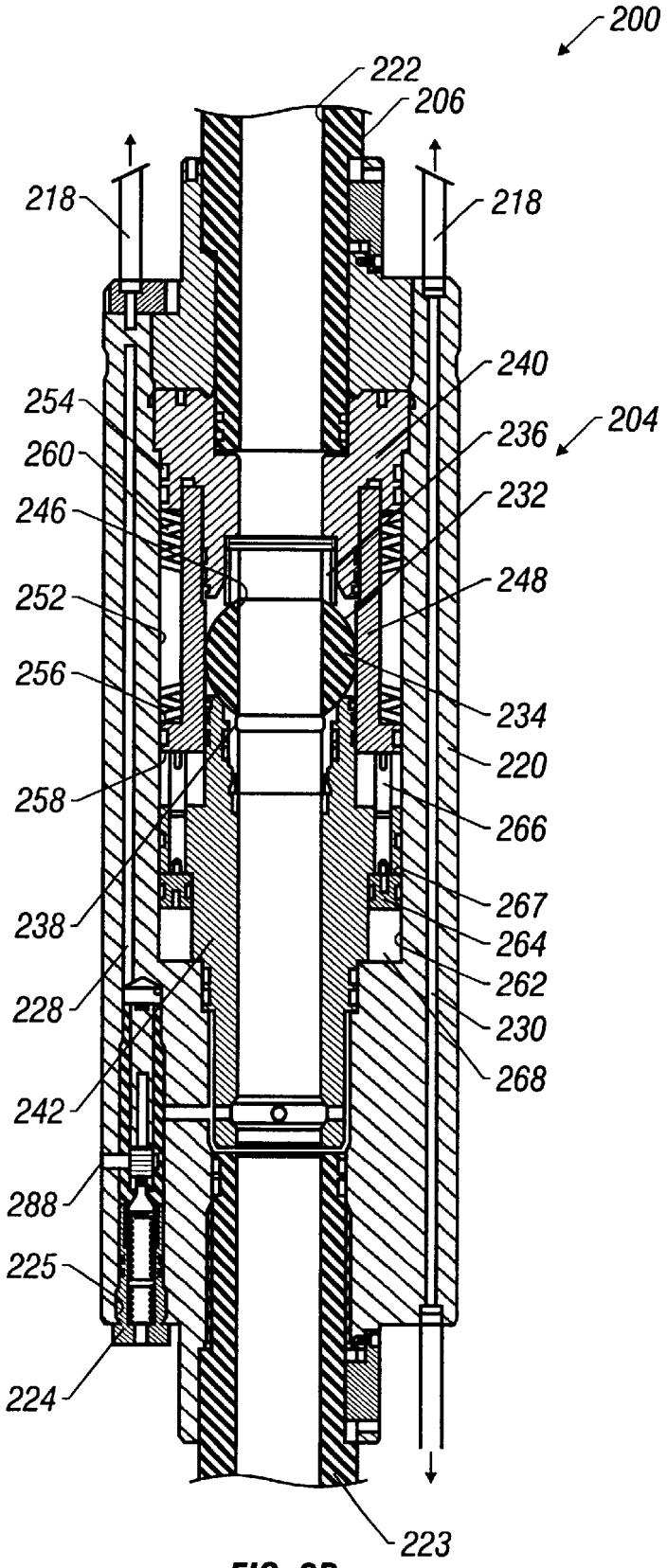

FIGS. 2A and 2B show cross sections of the retainer valve 200. The retainer valve 200 comprises a spanner joint 202 (shown in FIG. 2A) and a valve section 204 (shown in FIG. 2B). The spanner joint 202 and the valve section 204 are connected by a flow tube 206. Referring to FIG. 2A, the spanner joint 202 includes a housing body 208 which is provided with a bore 210. The bore 210 is aligned with the bore 116 (shown in FIG. 1) of the tubing string 114 when the retainer valve 200 is inline with the tubing string 114. An upper sub 212 is secured to the upper end of the housing body 208 by a threaded connection or other suitable connection. A torque pin 213 prevents the housing body 208 from being over-tightened and makes assembly and disassembly of the housing body 208 and the upper sub 212 easier. The upper sub 212 is provided to couple the housing body 108 to the upper portion 132 of the tubing string 114 (shown in FIG. 1). The flow tube 206 is secured to the lower end of the housing body 208 by a threaded connection or other suitable connection.

A sleeve 214 is mounted at a lower end of the housing body 208. The sleeve 214 is locked to the housing body 208 by lock pins 215 to prevent it from loosening while the spanner joint 202 is in use. A support member 216 is mounted between the sleeve 214 and the housing body 208. The support member 216 centralizes the flow tube 206 within the sleeve 214. The support member 216 also allows passage of flow control lines 218 while preventing damage to the flow control lines 218. The flow control lines 218 connect the control lines in the umbilical 136 (shown in FIG. 1) to various points in the valve section 204 (shown in FIG. 2B). The flow control lines 218 extend through the housing body 208 and apertures in the support member 216. Additional flow lines that are not connected to the control lines in the umbilical 136 also extend through the spanner joint 202 to various points in the valve section 204 (shown in FIG. 2B).

Referring to FIG. 2B, the valve section 204 includes a housing 220 which is provided with a bore 222. The bore 222 is aligned with the bore 116 (shown in FIG. 1) of the tubing string 114 when the retainer valve 200 is inline with the tubing string 114. The lower end of the flow tube 206, which was previously illustrated in FIG. 2A, is secured to the upper end of the housing 220 by a threaded connection or other suitable connection. A lower sub 223 is secured to the lower end of the housing 220. The lower sub 223 allows the housing 220 to be coupled to the tubing string 114 (shown in FIG. 1).

A bleed-off valve 224 is mounted in an outer cavity 225 in the housing 220. A sequencing valve (not shown) is also mounted in an outer cavity (not shown) in the housing 220. The bleed-off valve 224 is controlled by fluid pressure in flow conduit 228 in the housing 220. The sequencing valve is an in-line pressure relief valve which allows transmission of pressure downstream to the latch 126 (shown in FIG. 1) once a minimum specified pressure in a flow conduit (not shown) connected to the sequencing valve has been surpassed. A flow conduit 230 runs through the housing 220 and is connected to the subsea tree 120 (shown in FIG. 1). The flow conduits 228 and 230 and the flow conduit connected to the sequencing valve are connected to the flow control lines 218 from the spanner joint 202 (shown in FIG. 2A).

A ball valve 232 is arranged inside the housing 220 to control fluid flow through the housing. The ball valve 232 includes a ball element 234 which is supported by valve seats 236 and 238. The valve seats 236 and 238 are held in place in the housing 220 by valve seat retainers 240 and 242, respectively. The ball element 234 has a bore 246 which is movable between an open position to allow fluid flow through the housing 220 and a closed position to prevent fluid flow through the housing 220. The orientation of the bore 246 of the ball element 234 is controlled by axial movement of a control sleeve or valve operator 248. Although not shown, the ball element 234 is mounted on pins which extend into diametrically opposed apertures in the control sleeve 248 so that when the control sleeve 248 is moved axially, the ball element 234 rotates. A seal (not shown) prevents leakage past the ball element 234 and holds pressure from above when the valve 232 is in the closed position.

The control sleeve 248 and the valve seat retainers 240 and 242 define an annular chamber 252. Fluid leakage from the annular chamber 252 into the bore 222 of the housing is prevented by seals 254. The face 256 of the control sleeve 248 is exposed to fluid pressure in one of the flow control lines 218 from the spanner joint 202 (shown in FIG. 2A). The face 258 of the control sleeve 248 is exposed to fluid pressure in one of the flow control lines 218 from the spanner joint 202 (shown in FIG. 2A). The control sleeve 248 is normally biased against the valve seat retainer 242 by belleville springs 260 or other suitable spring or biasing device so that the ball valve 232 is normally in the closed position. However, when fluid pressure that is sufficient to overcome the action of the springs 260 is applied to the face 258 of the control sleeve 248, the control sleeve 248 will move upwardly to open the valve 232. The valve 232 returns to the closed position if the fluid pressure acting on the face 258 is released. Additional pressure may be applied to the face 256 of the control sleeve 248 from one of the flow control lines 218 to assist the spring 260 in fully closing the ball valve 232.

An inner chamber 262 is defined between the valve seat retainer 242 and the housing 220. A piston 264 inside the inner chamber 262 may move axially within the inner chamber 262 in response to pressure differential acting across it. The piston 264 is connected to the control sleeve 248 by piston rods 266. Thus, the motion of the piston 264 is transmitted to the control sleeve 248 by the piston rods 266. The piston 264 divides the inner chamber 262 into an upper chamber 267 and a lower chamber 268. The upper chamber 267 is vented to the riser 106 (shown in FIG. 1) by a flow line 290 (FIG. 4) which runs through the housing 220 and the spanner joint 202 (shown in FIG. 2A) to the annular passage between the riser 106 and the tubing string 114 (shown in FIG. 1). The lower chamber 268 is also vented to the annular passage between the riser 106 and the tubing string 114 (shown in FIG. 1) through a control line 292 (FIG. 4) that runs from the lower chamber 268 and terminates at the upper end of the valve section 204.

In operation, and with reference to FIG. 1, the subsea tree 120 and the retainer valve 200 are landed in the subsea blowout preventer stack 108 on the tubing string 114. The valves 128 and 130 in the subsea tree 120 and the valve 232 of the retainer valve 200 are open to allow fluid flow from the lower portion 119 of the tubing string 114 to the upper portion 132 of the tubing string 114. In the event of an emergency, the valves 128 and 130 can be automatically closed to prevent fluid from flowing from the lower portion 119 of the tubing string 114 to the upper portion 132 of the tubing string 114. Once the valves 128 and 130 are closed, the upper portion 132 of the tubing string 114 may be disconnected from the subsea tree 120 and retrieved to the vessel 102 or raised to a level which will permit the vessel 102 to drive off if necessary.

Before disconnecting the upper portion 132 of the tubing string 114 from the subsea tree 120, the retainer valve 200 is closed by moving the ball element 234 (shown in FIG. 2B) to the closed position. The closed retainer valve 200 prevents fluid from being dumped out of the upper portion 132 of the tubing string 114 when the upper portion 132 of the tubing string 114 is disconnected from the subsea tree 120. When the retainer valve 200 is closed, pressure is trapped between the retainer valve 200 and the valve portion 124 of the subsea tree 120. The bleed-off valve 224 is operated to bleed the trapped pressure in a controlled manner. After bleeding the trapped pressure, the latch 126 may be operated to disconnect the upper portion 132 of the tubing string 114 from the subsea tree 120.

The blowout preventer stack 108 includes pipe ram seals 138 and shear ram seal 140. However, other combinations of ram seals may be used. A lower marine riser package 109 is mounted between the blowout preventer stack 108 and the riser 106. The lower marine riser package 109 includes annular preventer seals 142. The lower marine riser package 109 also typically includes control modules (not shown) for operating the annular preventer seals 142, the ram seals 138 and 140 in the blowout preventer stack 108, and other controls as needed. The ram seals 138 and 140 and the annular preventer seals 142 define a passage 143 for receiving the tubing string 114. The subsea tree 120 is arranged within the blowout preventer stack 108, and the retainer valve 200 extends from the subsea tree 120 into the annular preventers 142.

Figure 4:
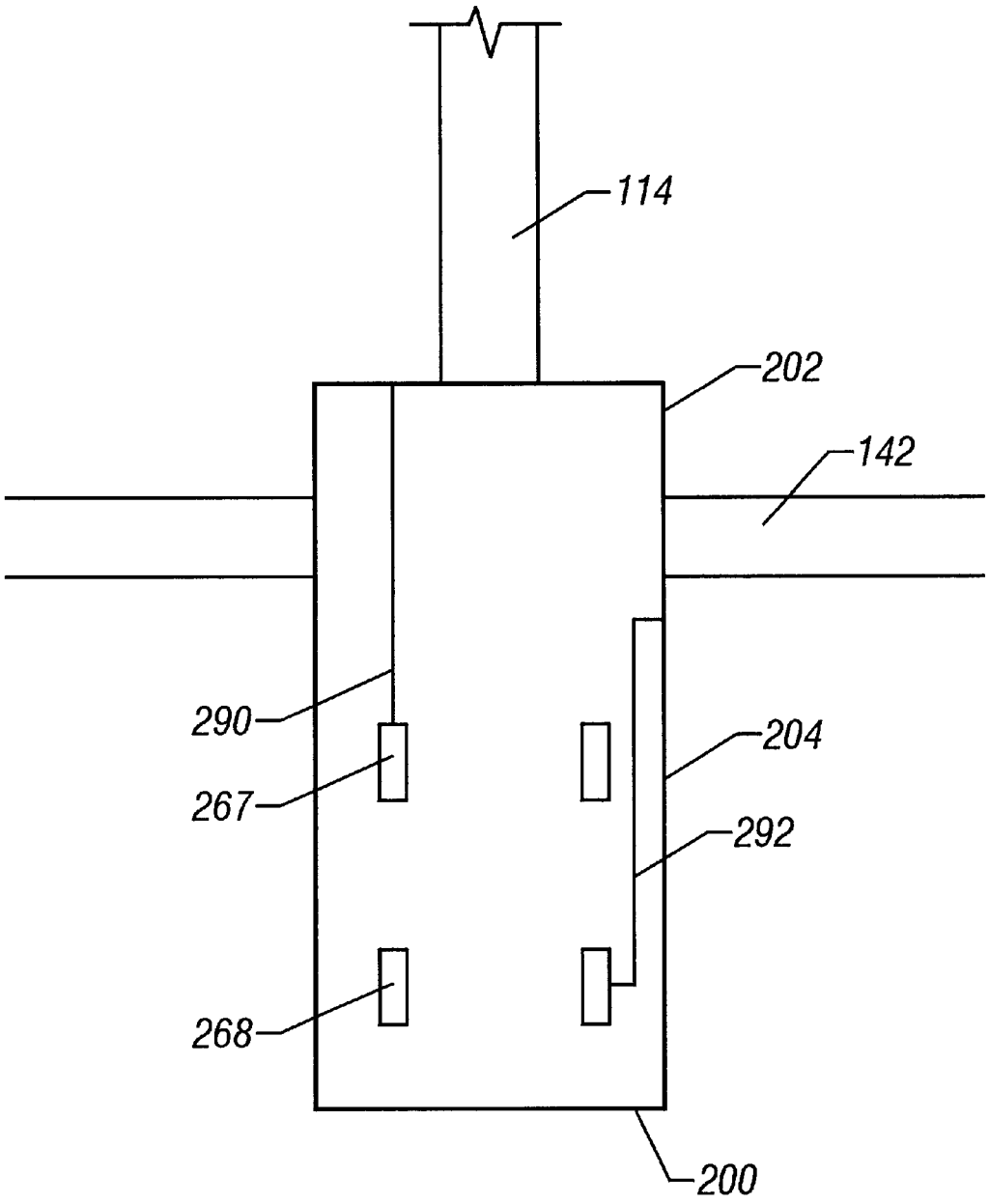
FIG. 4 is a schematic of the retainer valve and annular preventer seals.

Referring now to FIGS. 1, 2B, and 4, the lower chamber 268 in the valve section 204 of the retainer valve 200 is vented to pressure below the annular preventers 142, and the upper chamber 267 is vented to pressure above the annular preventers 142. When one or both of the annular preventers 142 closes around the spanner joint 202, choke/kill lines (not shown) may be used to pressurize the fluid below the annular preventers 142 so that pressure in the lower chamber 268 is higher than the pressure in the upper chamber 267. Thus, when sufficient pressure differential is created between the upper chamber 267 and the lower chamber 268, the piston 264 moves upwardly. The upward motion of the piston 264 is transmitted to the control sleeve 248 through the piston rods 266 to open the ball element 234. This allows the valve 232 to be re-opened if the flow control line that applies fluid pressure to the control sleeve 248 is inoperable. It should be clear that a different type of blowout preventer, e.g., a pipe ram preventer, or other type of wellhead assembly that includes a sealing member, e.g., a diverter, may close around the spanner joint 202 to permit the desired pressure differential to be created between the chambers 267 and 268.

Figure 3:
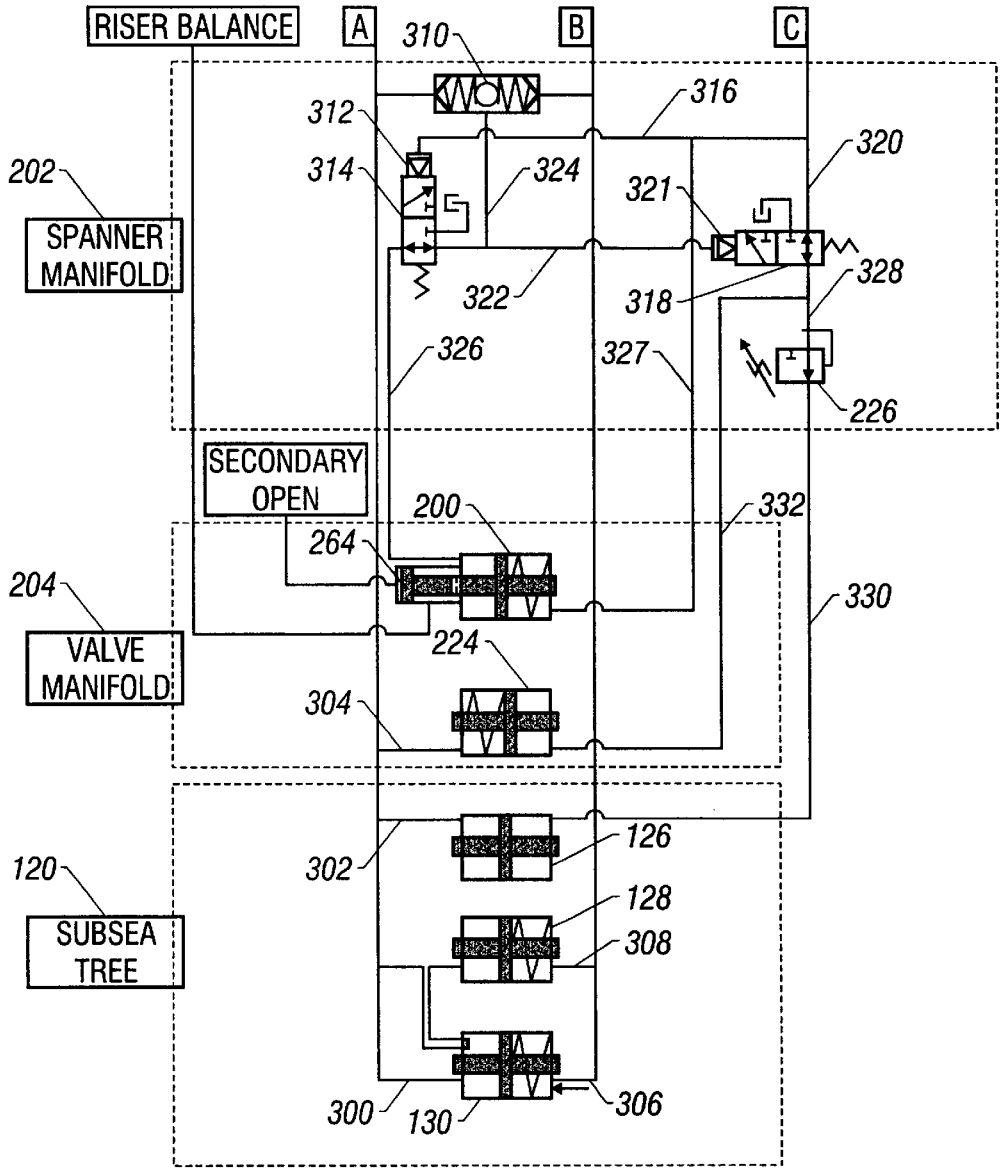
FIG. 3 is a schematic of a control system for the safety shut-in system included in the subsea production well testing system shown in FIG. 1.

Referring to FIG. 3, a control system for the safety shut-in system 118 is shown. The three control lines in the umbilical 136 are identified as control lines A, B, and C. Control line A is connected to the ball valve 130, the latch 126, and the bleed-off valve 224 by flow lines 300, 302, and 304, respectively. Pressure in control line A opens the ball valve 130, locks the latch 126, and assists-close the bleed-off valve 224. The flapper valve 128 is connected to the ball valve 130 such that when the ball valve 130 is opened, the flapper valve 128 is also opened. Control line B is connected to the ball valve 130 and the flapper valve 128 by flow lines 306 and 308, respectively. The ball valve 130 and the flapper valve 128 are closed when control line B is pressurized and pressure in control line A is released.

Typically, when pressure is released from the control line A and there is no pressure in control line B, the ball valve 130 and the flapper valve 128 will close because of the action of the springs normally biasing the ball valve 130 and flapper valve 128 to the closed position. However, if there is a blockage from debris or coiled tubing inside the bore of the ball valve 130 and/or the flapper valve 128, then additional force may be required to close the ball valve 130 and/or flapper valve 128. This additional force is provided by pressure in control line B.

Control lines A and B are connected to a shuttle valve 310. Control line C is connected to a pilot 312 of a control valve 314 by a flow line 316 and to a port of a control valve 318 by a flow line 320. The control valve 312 is connected to the pilot 321 of the control valve 318 by a flow line 322. The control valve 318 is normally open. A flow line 324 connects the shuttle valve 310 to the flow line 322. When there is pressure in control lines A or B, the control valve 318 is closed. Control valve 314 is closed when there is pressure in control line C. Control valve 318 is open when there is no pressure in the flow line 322.

Control valve 314 is connected to the retainer valve 200 by a flow line 326. Pressure in the flow line 326, which is indicative of pressure in control lines A or B, opens the retainer valve 200. The retainer valve 200 is also connected to the flow line 316 by a flow line 327 so that when control line C is pressurized, the retainer valve 200 closes. The control valve 318 is connected to the sequencing valve 226 by a control line 328 and the sequencing valve is connected to the latch 126 by a flow line 330. The control line 328 is also connected to the bleed-off valve 224 by a flow line 332. When the control valve 318 is open, pressure in control line C is communicated to the bleed-off valve 224 and the sequencing valve 226. The bleed-off valve 224 is opened and pressure trapped between the retainer valve 200 and the ball valve 130 and flapper valve 128 is vented off to the riser annulus through the port 288 (shown in FIG. 2B) in the housing 220. When pressure in the control line 328 surpasses a predetermined amount, the sequencing valve 226 allows pressure to be transmitted to control line 330 to unlock the latch 126.

In operation, this control logic allows the ball valve 130 and flapper valve 128, the latch 126, the retainer valve 200, and the bleed-off valve 224 to be independently controlled. The outcome is sequence dependent. It is important that the latch 126 is not unlocked until all the other valves are closed. This is accomplished by the normally open control valve 318. If there is pressure in control line A or B, then the control valve 318 is in the closed position and the latch 128 cannot be unlocked. By following a predetermined sequence, the retainer valve 200 or the ball valve 130 and the flapper valve 128 can be closed first. When pressure is applied to control line A, the ball valve 130 and the flapper valve 128 open, the latch 126 locks, and the bleed-off valve 224 has close-assist pressure applied to it. The retainer valve 200 remains open. When pressure is applied to control line B, the ball valve 130 and the flapper valve 128 fail-safe close. Upon bleeding pressure off control line A, the ball valve 130 and the flapper valve 128 close with pressure assist. The retainer valve 200 is then closed by bleeding pressure off control line B.

The retainer valve 200 will remain open by applying pressure to control line A or B. The retainer valve 200 closes when pressure is applied to control line C and both lines A and B are bled of pressure. If pressure is held on line A and pressure is applied to line C, then the ball valve 130 and the flapper valve 128 will be held open, and the retainer valve 200 will close first. To unlock the latch 126, pressure must be applied to control line C and both control lines A and B must have no pressure. The retainer valve 200 can be reopened by applying pressure differential across the piston 264 as previously described.

While the invention has been described with respect to a limited number of embodiments, those skilled in the art will appreciate numerous variations therefrom without departing from the spirit and scope of the invention. For example, the ball valve 232 in the retainer valve 200 may be replaced with other types of valves, e.g., flapper valve or gate valve. The subsea tree 120 may have other valves and may have a different configuration. The pilots 312 and 321 may be replaced with control valves that are electrically controlled with solenoids.

Other means of controlling the opening of the ball valve 232 when the flow control line that supplies pressure to the control sleeve 248 is inoperable may also be provided. For example, the piston rods 266 and the piston 264 could be replaced with a secondary piston that acts directly against the face 258 of the control sleeve 248, and the inner chamber 262 could be connected to the riser annulus via a port (not shown) in the housing body 220. A rupture disc (not shown) may be mounted in the port and configured to burst when a predetermined pressure is applied to the riser annulus, e.g., when the annular preventer 142 is closed around the spanner joint 202 and choke/kill lines are used to pressurize the lower section of the riser annulus to the predetermined pressure. When the rupture disc bursts, the secondary piston would be exposed to the pressure in the riser annulus and act accordingly on the control sleeve 248. The rupture disc may be selected such that the pressure required to burst the rupture disc is sufficient to overcome the biasing force of the springs 260. In this way, when the rupture disc bursts, the control sleeve 248 moves upwardly and opens the ball valve 232. Using a rupture disc allows the retainer valve to be re-opened only once. With the piston 264, the retainer valve can be re-opened repeatedly. Instead of using a rupture disc, the piston 264 may also be locked to the housing by shear pins that are adapted to break when pressure in the lower section of the riser annulus is set to a predetermined pressure.

What is claimed is:

1. An apparatus for retaining fluid in a pipe, comprising:

an elongated body adapted to be positioned within a subsea wellhead assembly, the elongated body having an end adapted for connection to the pipe, a flow passage for fluid communication with the pipe, and an outer surface for engagement with a sealing member in the subsea wellhead assembly;

a first chamber defined within the elongated body and connected to receive pressure from one side of the sealing member in the subsea wellhead assembly; and a second chamber defined within the elongated body and connected to receive pressure from another side of the sealing member in the subsea wellhead assembly; and a valve supported in the elongated body adapted to be moved by pressure differential between the first and second chambers, the valve being movable between an open position to permit fluid flow through the flow passage and a closed position to prevent fluid flow through the flow passage.

2. The apparatus of claim 1, wherein the wellhead assembly comprises an annular blowout preventer, the elongated body adapted to be positioned within the annular blowout preventer.

3. The apparatus of claim 1, further comprising an axially movable sleeve disposed within the elongated body and adapted to move the valve between the open and closed positions.

4. The apparatus of claim 3, further comprising a piston disposed between the chambers and coupled to the axially movable sleeve, the piston adapted to be axially moved within the elongated body in response to the pressure differential between the first and second chambers.

5. The apparatus of claim 1, wherein the valve includes a ball element mounted on a valve seat, the valve seat surrounding the flow passage and sealingly engaging the ball element and the elongated body such that the ball element when closed retains fluid in the pipe.

6. The apparatus of claim 1, further comprising a sleeve having a first surface for communication with a fluid pressure control line, the sleeve adapted to be moved by either pressure in the fluid pressure control line or the pressure differential between the first and second chambers to actuate the valve.

7. The apparatus of claim 6, further comprising a piston disposed between the first and second chambers and coupled to the sleeve, the piston adapted to be moved by pressure differential between the first and second chambers.

8. The apparatus of claim 7, comprising a back-up actuation mechanism, the back-up actuation mechanism comprising the piston and activable to operate the valve in case of failure of the fluid pressure control line.

9. The apparatus of claim 7, further comprising a third chamber, wherein the sleeve is disposed between the third chamber and the first chamber.

10. The apparatus of claim 9, further comprising a spring in the third chamber to bias the valve to a first position.

11. The apparatus of claim 10, wherein the sleeve has a second surface in contact with the spring.

12. An apparatus for controlling fluid flow in a pipe extending from a rig through a subsea blowout preventer into a subsea well, comprising:

a control valve connected to a lower portion of the pipe that extends into the subsea well;

a retainer valve connected to an upper portion of the pipe above the subsea well, the retainer valve comprising:

an elongated body adapted to be positioned within the subsea blowout preventer, the elongated body having an end adapted for connection to the pipe, a flow passage for fluid communication with the pipe, and an outer surface for engagement with a sealing member in the subsea blowout preventer;

a first chamber defined within the elongated body and connected to receive pressure from one side of the sealing member;

a second chamber defined within the elongated body and connected to receive pressure from another side of the sealing member; and a valve supported in the elongated body for movement in response to pressure differential between the first and second chambers, the valve being movable between an open position to permit fluid flow through the flow passage and a closed position to prevent fluid flow through the flow passage; and a latch releasably connecting the control valve to the retainer valve.

13. The apparatus of claim 12, wherein the retainer valve further comprises an axially movable sleeve disposed within the elongated body and adapted to move the valve between the open and the closed positions.

14. The apparatus of claim 13, further comprising a spring cooperating with the sleeve to normally bias the valve to the closed position.

15. The apparatus of claim 13, further comprising a bleed-off valve for bleeding pressure trapped between the retainer valve and the control valve.

16. The apparatus of claim 13, wherein the valve includes a ball element and a valve seat, the valve seat surrounding the flow passage and sealingly engaging the ball element and the housing body such that the ball element when closed holds pressure from above.

17. The apparatus of claim 13, wherein the control valve is a normally-closed valve.

18. The apparatus of claim 12, wherein the retainer valve further comprises a sleeve having a first surface for communication with a fluid pressure control line, the sleeve adapted to be moved by pressure in the fluid pressure control line to actuate the valve.

19. A method for controlling fluid flow in a pipe extending from a rig through a subsea blowout preventer into a subsea well, the subsea blowout preventer having a sealing member, the method comprising:

providing a retainer valve in the pipe such that a flow passage in the retainer valve is in fluid communication with the pipe;

operating a movable member in the retainer valve to open the flow passage such that fluid can flow through the flow passage or close the flow passage such that fluid is prevented from flowing through the flow passage;

venting a first chamber in the retainer valve to pressure on one side of the sealing member in the subsea blowout preventer;

venting a second chamber in the retainer valve to pressure on another side of the sealing member in the subsea blowout preventer; and creating pressure differential between the first chamber and the second chamber to move the movable member.

20. The method of claim 19, wherein creating pressure differential between the first chamber and the second chamber to move the movable member comprises applying pressure to one side of the sealing member in the subsea blowout preventer.

21. The method of claim 20, further comprising applying the pressure through one of a choke line and a kill line.

22. The method of claim 21, wherein applying the pressure comprises applying pressure to a region below the sealing member.

23. The method of claim 19, further comprising providing a piston between the first and second chambers, the piston being coupled to the movable member.

24. The method of claim 23, further comprising applying pressure in a control line in communication with a first surface of the movable member to move the movable member.

25. The method of claim 24, wherein creating the pressure differential between the first and second chambers is performed to actuate the valve if the control line is faulty.

26. The method of claim 19, further comprising:

providing a control valve and a latch releasably coupling the retainer valve and the control valve; and actuating the latch to release the retainer valve from the control valve.

27. An apparatus for controlling fluid flow in a pipe extending from a rig through a subsea blowout preventer into a subsea well, comprising:

a control valve connected to a lower portion of the pipe that extends into the subsea well;

a retainer valve connected to an upper portion of the pipe above the subsea well, the retainer valve comprising:

an elongated body adapted to be positioned within the subsea blowout preventer, the elongated body having an end adapted for connection to the pipe, a flow passage for fluid communication with the pipe, and an outer surface for engagement with a sealing member in the subsea blowout preventer;

a first chamber defined within the elongated body and connected to receive pressure from above the sealing member;

a second chamber defined within the elongated body and connected to receive pressure from below the sealing member; and a valve supported in the elongated body for movement in response to pressure differential between the first and second chambers, the valve being movable between an open position to permit fluid flow through the flow passage and a closed position to prevent fluid flow through the flow passage; and a latch releasably connecting the control valve to the retainer valve, and wherein the retainer valve further comprises a sleeve having a first surface for communication with a fluid pressure control line, the sleeve adapted to be moved by pressure in the fluid pressure control line to actuate the valve, wherein the retainer valve further comprises a piston disposed between the first and second chambers and coupled to the sleeve, the piston adapted to be moved by pressure differential between the first and second chambers.

28. The apparatus of claim 27, wherein the piston and first and second chambers constitute a back-up actuation mechanism to the sleeve that is operable by the fluid pressure control line.

29. An apparatus for controlling fluid flow in a pipe extending from a rig through a subsea blowout preventer into a subsea well, comprising:

a control valve connected to a lower portion of the pipe that extends into the subsea well;

a retainer valve connected to an upper portion of the pipe above the subsea well, the retainer valve comprising:

an elongated body adapted to be positioned within the subsea blowout preventer, the elongated body having an end adapted for connection to the pipe, a flow passage for fluid communication with the pipe, and an outer surface for engagement with a sealing member in the subsea blowout preventer;

a first chamber defined within the elongated body and connected to receive pressure from above the sealing member;

a second chamber defined within the elongated body and connected to receive pressure from below the sealing member; and a valve supported in the elongated body for movement in response to pressure differential between the first and second chambers, the valve being movable between an open position to permit fluid flow through the flow passage and a closed position to prevent fluid flow through the flow passage; and a latch releasably connecting the control valve to the retainer valve, wherein the retainer valve further comprises a bleed valve adapted to bleed trapped pressure between the retainer valve and the control valve.

* * * * *